US005083880A

United States Patent [19]

Inomata et al.

[11] Patent Number: 5,083,880

[45] Date of Patent: Jan. 28, 1992

[54] PRINTING MEDIA FEEDING APPARATUS FOR PRINTERS

[75] Inventors: Mitsugu Inomata, Kawasaki; Haruhisa Inagaki, Suginami; Fumio Nakao, Kawasaki, all of Japan

[73] Assignee: Fujitsu Limited, Kawasaki, Japan

[21] Appl. No.: 554,368

[22] Filed: Jul. 19, 1990

[30] Foreign Application Priority Data

Jul. 19, 1989 [JP] Japan ..... 1-184784
Jul. 21, 1989 [JP] Japan ..... 1-187498

[51] Int. Cl.[5] ..... B41J 11/58

[52] U.S. Cl. ..... 400/624; 400/625; 271/162; 271/292

[58] Field of Search ..... 400/605, 624, 625, 629; 271/162, 163, 164, 241, 9, 4, 292, 207, 278, 279, 3

[56] References Cited

U.S. PATENT DOCUMENTS 4,231,561 11/1980 Kaneko et al. ..... 271/9
4,968,106 11/1990 Koyama ..... 271/162

FOREIGN PATENT DOCUMENTS 3723722 1/1988 Fed. Rep. of Germany ..... 400/625
0169445 7/1986 Japan ..... 271/207

*Primary Examiner*—Eugene H. Eickholt
*Attorney, Agent, or Firm*—Staas & Halsey

[57] ABSTRACT

A printer includes two printing sheet outlets each provided with a stacker mount on which a detachable stacker constituted as a single unit can be mounted. The stacker comprises a cut sheet supporting portion and an eject roller for ejecting cut sheets onto the supporting portion. A driving force is transmitted from a single drive source to the respective stacker mounts so that, when the stacker is selectively mounted on one of the mounts, the eject roller of the stacker can be operatively connected to the drive source and can be driven.

6 Claims, 3 Drawing Sheets

PRINTING MEDIA FEEDING APPARATUS FOR PRINTERS

BACKGROUND OF THE INVENTION

1. Field of the Invention

This invention relates to a printer, and more particularly, to a printer having a sheet ejecting means for discharging printing sheets or paper, particularly cut sheets, onto a sheet stacker mounted on the printer.

This invention also relates to a printer having an apparatus for advantageously feeding both cut sheets and a continuous sheet.

2. Description of the Related Art

To meet recent requirements for the capability of feeding various kinds of printing sheets therethrough, a printer having a plurality of printing sheet feeding paths has been developed. In such a printer, even if only cut sheets are used, a plurality of sheet inlets and outlets are provided which are selectively used according to the kind of cut sheet to be fed therethrough.

Many conventional printers having a plurality of sheet inlets and outlets are also provided with an automatic cut sheet feeder mounted at a fixed position on the printer. Moreover, a printer having a sheet stacker mountable at a fixed position thereon is known in the prior art.

Nevertheless, printers to which a sheet stacker can be selectively mounted at any one of a plurality of outlets through which various kinds of printing sheets are respectively discharged, are not known in the prior art.

SUMMARY OF THE INVENTION

It is an object of the present invention to provide a printer in which a sheet stacker can be selectively mounted at a suitable sheet outlet in accordance with a selected kind of printing sheet.

Another object of the present invention is to provide a printer which can utilize both cut sheets and a continuous sheet.

According to one aspect of the present invention, there is provided a printer comprising a printer body a plurality of printing sheet outlet means arranged at different positions on the printer body a plurality of stacker mounts provided in the respective outlet means; a stacker constituted as a single detachable unit comprising a cut sheet supporting portion and an ejecting means for ejecting cut sheets onto the supporting station; and a plurality of drive transmitting means for transmitting a drive force to the ejecting means of the stacker selectively mounted at one of the plurality of stacker mounts.

The above arrangement is advantageous in that the plurality of drive transmitting means are associated with the respective stacker mounts, and therefore, when the stacker is selectively mounted at one of the plurality of stacker mounts, the ejecting means of the stacker is operatively connected to the drive transmitting means associated with that stacker mount. Accordingly, in such a printer, a number of printed sheets can be stacked at any one of a plurality of outlets by a single sheet stacker having a required capacity.

In another aspect of the present invention, there is provided a printer comprising a printing portion means for defining a sheet path along which a printing medium, including both cut sheets and a continuous sheet, is passed through the printing portion, the sheet path defining means comprising a pair of first feed rollers arranged upstream of the printing portion with respect to a normal feeding direction of the printing media; means for releasing the first feed rollers; a pair of second feed rollers arranged downstream of the printing portion with respect to the normal feeding direction; a feed tractor having a plurality of feeding pins engagable with perforations of the continuous printing sheet to feed same through the printer, the feed tractor being arranged upstream of the printing portion with respect to a normal feeding direction of the printing sheet; and means for operating the sheet path defining means in such a manner that when cut sheets are applied, the first rollers are driven in normal direction at a predetermined feeding speed with a predetermined feeding force and the second rollers are also driven in the normal direction at a slightly higher feeding speed than the predetermined feeding speed with a slightly smaller feeding force than the predetermined feeding force. If the cut sheet is reversely fed, the first rollers are driven in the reverse direction but the second rollers are freely rotatable and when a continuous sheet is applied, the first rollers are released, the feeding tractor is driven in the normal direction at a predetermined feeding speed with a predetermined feeding force, and the second rollers are also driven in the normal direction at a slightly higher feeding speed than the predetermined feeding speed with a slightly smaller feeding force than the predetermined feeding force. If the continuous sheet is reversely fed, the feeding tractor is driven in the reverse direction and the second rollers are freely rotatable.

In the above-described printer, both cut sheets and a continuous sheet can be stably and smoothly fed with a small number of feed rollers, and these feed rollers or the sheet feed tractor can be advantageously fitted in a compact arrangement in the printer.

DESCRIPTION OF THE PREFERRED EMBODIMENTS

Figure 1:
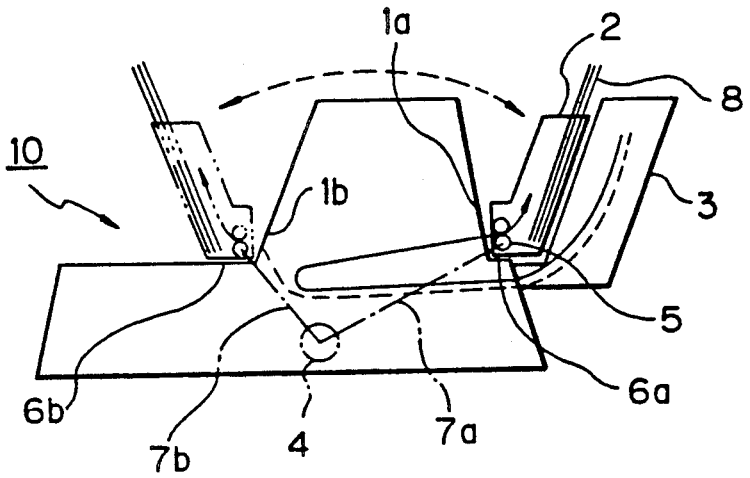
FIG. 1 is a schematic side elevational view of a printer having a sheet feeding means according to the present invention.

Referring now to the drawings, as schematically illustrated in FIG. 1, a printer 10 is provided with a plurality of cut sheet outlets 1*a* and 1*b*, a sheet stacker 2, a cut sheet feeder 3, and a drive means 4 for rotating a platen for feeding the cut sheets 8.

The sheet stacker 2 is provided with an ejecting means, such as at least one pair of eject rollers 5, and is constituted as a detachable single unit separate from the cut sheet feeder 3. The ejecting means ejects cut sheets onto a cut sheet supporting portion 2*b*.

Each of the cut sheet outlets 1*a* and 1*b* is provided with a stacker mount 6*a* or 6*b*, respectively, whereby the sheet stacker 2 can be selectively mounted on either one of the stacker mounts 6a and 6b, as illustrated in FIG. 1 by a solid line and a phantom line, respectively. As easily understood, each of the stacker mounts 6a and 6b is provided with any suitable positioning means for mounting the sheet stacker 2 at a predetermined position.

A first transmitting means 7a transmits a drive force from the drive means 4 to the eject rollers 5 of the sheet stacker 2, when the latter is mounted on the stacker mount 6a as illustrated by a solid line, and a second transmitting means 7b transmits the same drive force from the drive means 4 to the eject rollers 5 of the sheet stacker 2 when the latter in mounted on the stacker mount 6b, as illustrated by a phantom line. Any known transmitting means, such as one comprising a plurality of gears, can be used as the transmitting means 7a and 7b.

The operation of the printer as illustrated in FIG. 1 will now be described with reference to FIGS. 2, 3, and 4, which show the respective flows of a printing sheet when the sheet stacker 2 is arranged in different positions.

Figure 2:
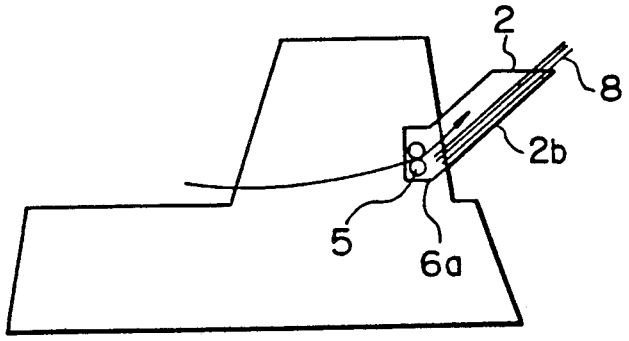
FIGS. 2 through 4 are schematic side views of the printer shown in FIG. 1, but illustrating different positions of a sheet stacker and a cut sheet feeder.

In FIG. 2, the stacker 2 is mounted on the rear stacker mount 6a, and the printing sheet 8 (i.e., a cut sheet) is manually inserted from the front of the printer, and after printing, is discharged onto the stacker 2, as shown by an arrow.

Figure 3:
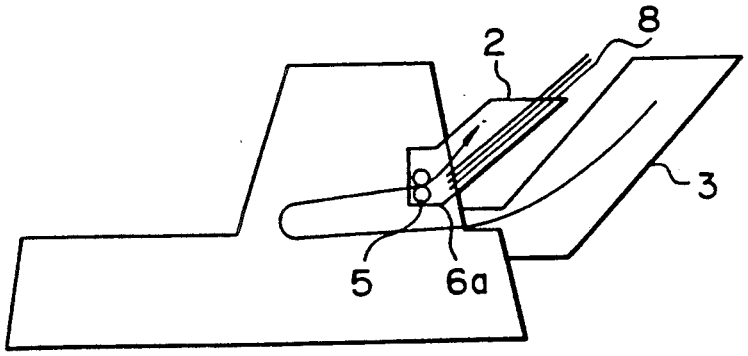

In FIG. 3, the stacker 2 is mounted on the same rear stacker mount 6a, but an automatic cut sheet feeder 3 is also mounted at the rear of the printer, under the stacker 2. The printing sheet 8 is automatically supplied by the cut sheet feeder 3, and after printing, is turned to be fed in the opposite direction and discharged onto the stacker 2, as shown by an arrow.

Figure 4:
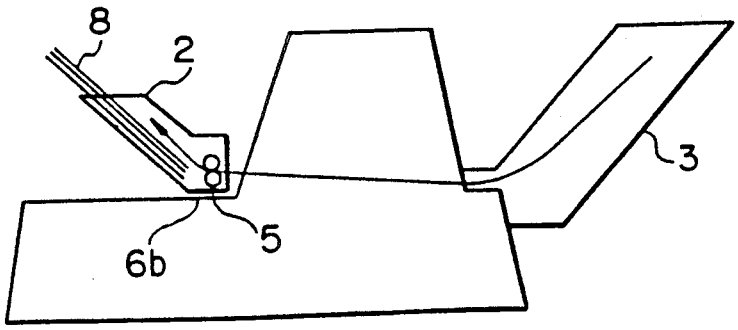

In FIG. 4, the stacker 2 is mounted on the front stacker mount 6b, and the cut sheet feeder 3 is mounted at the rear of the printer as shown in FIG. 3. The printing sheet 8 is automatically supplied by the cut sheet feeder 3, and after printing, is discharged onto the stacker 2, as shown by an arrow.

In the embodiments shown in FIGS. 2 and 3, the eject rollers 5 of the stacker 2 are driven by the first drive means 7a, but in the embodiment shown in FIG. 4, the eject rollers 5 of the stacker 2 are driven by the second drive means 7b. Therefore, according to the present invention, the printing or printed sheets 8 can be supplied in different ways and stacked while using only a single stacker 2 having a required stacking capacity.

Figure 5:
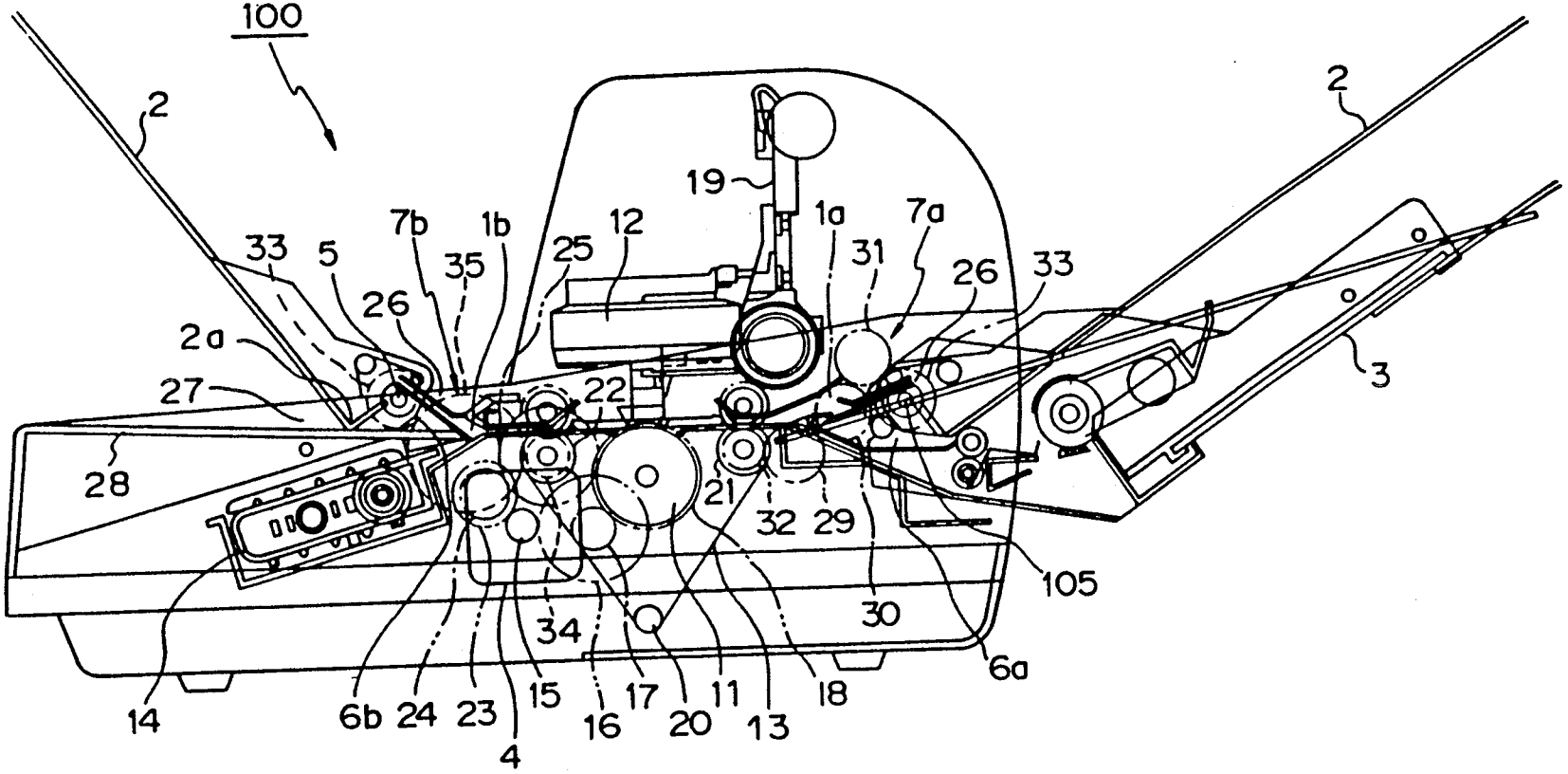
FIG. 5 is a detailed side elevational view of the printer shown in FIG. 1.

FIG. 5 is a detailed side view of the printer shown in FIG. 1. As shown in FIG. 5, the printer comprises a platen 11, a printing head 12, a sheet feeding belt 13, and a sheet feeding tractor 14 used for feeding a continuous printing sheet. The same or corresponding members or parts as shown in FIG. 1 are indicated in FIG. 5 by the same reference marks or numerals.

The platen 11 is arranged in a housing body of the printer and driven by the drive source 4 via a plurality of gears 15, 16, 17, and 18, and the platen 11 rotates in the same rotational direction as the gear 15. The gear 18 is attached to a shaft on which the platen 11 is mounted.

The printing head 12 is mounted on a carrier 19, which is moved in the direction perpendicular to the plane of FIG. 5, while the printing head 12 is positioned opposite to the cylindrical surface of the platen 11.

The belt 13 runs through pulleys 20, 21, and 22 driven in the same direction as the platen 11 by the drive source 4, via the gear 15, gears 23 and 24 attached to the same shaft, and another gear 25 mounted on the same shaft as that to which the pulley 22 is attached.

The sheet stacker 2 is provided with a sheet guide 26, in addition to the eject rollers 5. In FIG. 5, two same-sized sheet stackers 2 are illustrated as if mounted at the rear and front of the printer, respectively, but in practice, the sheet stacker 2 is usually mounted selectively at either the rear or front of the printer.

Figure 6:
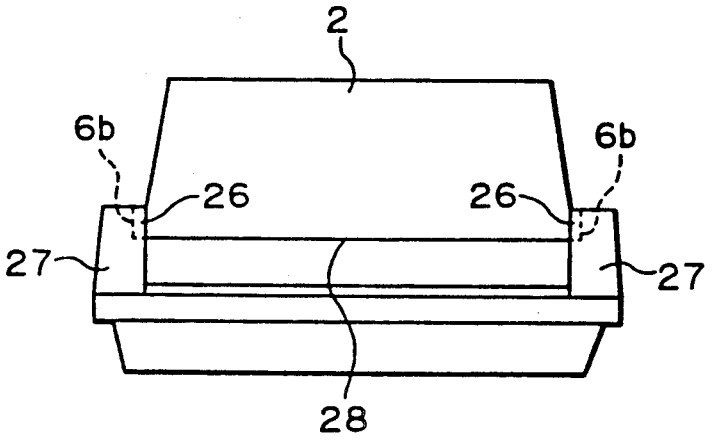
FIG. 6 is a front view of the printer shown in FIG. 1 and illustrating a mount for the stacker.

The structures and the operations of the stacker mounts 6a and 6b for the sheet stacker 2 will now be described with reference to FIG. 6. As exemplified in FIG. 6, the stacker mount 6b comprises a pair of recesses provided in the left and right side walls 27, respectively, of the printer housing. The stacker 2 is mounted on the printer by inserting the sheet guide 26 of the stacker 2 into and along the stacker mount recesses 6b. In this state, the bottom 2a of the stacker 2 bears against a table 28 of the printer housing. Note, the stacker mount 6a has the same structure as the stacker mount 6b described above.

The first transmitting means 7a comprises a plurality of gears 29, 30, and 31 engaged with each other. The gear 29 engages with a gear 32 mounted on a shaft to which the pulley 21 is attached, and the gear 31 is engaged with a gear 33 mounted on a shaft on which one of the eject rollers 5 of the stacker 2 is also mounted. Therefore, when the stacker 2 is mounted at the sheet outlet 1a, if the drive means 4 is driven, the gear 33 rotates with the eject roller 5 in the same direction as the gear 15.

In the same manner, the second transmitting means 7b comprises a pair of gears 34 and 35 engaged with each other. The gear 34 is mounted on the same shaft as that to which the gear 25 is attached, and the gear 35 is engaged with the gear 33 mounted on the shaft on which the above-mentioned eject roller 5 of the stacker 2 is mounted. Therefore, when the stacker 2 is mounted at the sheet outlet 1b, if the drive means 4 is driven, the gear 33 rotates with the eject roller 5 in the same direction as the gear 15.

When cut sheets are to be printed, the cut sheets are fed one by one from the cut sheet feeder 3 mounted at the rear of the printer and are passed through the printing head 12, which moves transversely to the printing sheet along the platen 11. The printing head 12 is controlled in accordance with a predetermined printing pattern to be printed on the cut sheet.

Figure 7:
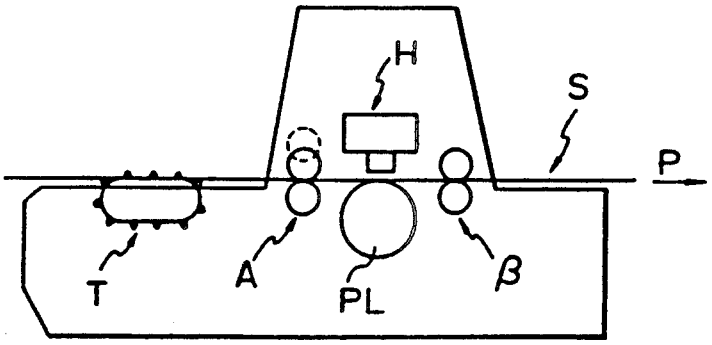
FIG. 7 is a schematic side elevational view of another embodiment of a sheet feeding means of a printer according to the present invention.

FIG. 7 shows another embodiment of a printer, in which a printing sheet S is fed in the horizontal direction as shown by an arrow P. The printer comprises a printing head H and a platen PL arranged opposite to the printing head H to define a printing gap therebetween. Along the path of the printing sheet S moving through the above-mentioned printing gap are arranged two pairs of feed rollers A and B, in front and behind (left and right in FIG. 7), respectively, with respect to the movement of the printing sheet S through the printing head H.

The feed rollers A and B can be made of any suitable material, such as rubber or plastic, and one of each pair of the feed rollers A and B is a drive roller and the other is a pinch roller, whereby the printing sheet S is fed therebetween by a friction force exerted therebetween, as well known in this field of art.

These feed rollers A and B are constituted to control the friction forces by, for example, a change of the material thereof (i.e., selecting the material to obtain a different friction force) or a change in the pressure of the pinch roller against the driving roller, in such a manner that the feed force imposed by the front pair of feed rollers A is larger than that imposed by the rear pair of feed rollers B.

Also, these pairs of rollers A and B are constituted to control the feed speed thereof by, for example, using different drive sources, or changing the gear ratio when the same drive source is used for both pairs of rollers A and B, in such a manner that the feed speed of the rear pair of feed rollers B is slightly higher than that of the front pair of feed rollers A. Namely, the front pair of feed rollers A are rotated at a predetermined nominal speed and the rear pair of feed rollers B are rotated at a higher speed. Further, the front pair of feed rollers A are able to feed the printing sheet in both the forward and reverse directions, and can be released or opened by moving the pinch roller away from the drive roller, as shown by a dotted line.

The drive roller of the rear pair of feed rollers B has a ratchet associated therewith, and thus the printing sheet S can be fed only in the forward direction P by the rollers B. Therefore, while these rollers B are inoperative, if the printing sheet S is moved in the opposite direction by the rollers A, a back tension or braking force is imparted to the printing sheet S by the rollers B.

A pin feed tractor T for feeding a continuous printing sheet is arranged in front of the pair of rollers A, and is provided with a plurality of pins which engage with perforations (not shown) provided at both sides of the continuous printing sheet S, to thereby feed the same. Therefore, when cut sheets are to be fed, the tractor T is not operated. The tractor T can feed the continuous printing sheet not only in the forward but also in the reverse direction.

When cut sheets S are used, the cut sheet S is fed by both the rear rollers B and the front rollers A. As the speed of the rear rollers B is higher than that of the front rollers A, and the force applied by the rear rollers B is smaller than that of the front rollers A, the cut sheet is fed by the front rollers A at a predetermined nominal speed while a back tension is given to the cut sheet S as it passes through the rear rollers B, which slip over the printing sheet.

When it is necessary to return a printing sheet S to a predetermined position, if the printing sheet S is a cut sheet, the operation of the rear feed rollers B is stopped and the front feed rollers A are driven in the opposite direction by a predetermined rotational angle. Accordingly, the cut sheet S is returned to the predetermined position by the front rollers A and a slight braking force is exerted by the freely rotatable rear rollers B.

When a continuous printing sheet is used, the pinch roller of the front pair of rollers A is moved upward and, therefore, the front rollers A have no affect on the continuous printing sheet. Therefore, the continuous printing sheet is fed at a predetermined nominal speed by the pin tractor T, and a back tension is given to the continuous printing sheet when it passes through the rear rollers B, which slip over the printing sheet.

When it is necessary to return the continuous printing sheet to a predetermined position, the pinch roller of the front rollers A is released or opened and the operation of the rear rollers B is stopped, and accordingly, the sheet is returned to the predetermined position by the pin tractor T while a slight braking force is exerted thereon by the freely rotatable rear rollers B.

Therefore, according to the embodiment shown in FIG. 7, only two pairs of feed rollers are necessary which are located in front of and behind the printing head. The number of rollers required in the printer therefore can be minimized, and thus the cost of the printer can be reduced. Further, the printing performance can be improved by reducing possible aberrations or discrepancies in the printed products, since a suitable back tension can be imposed on the printing sheet due to an appropriate slippage of the printing sheet or a free rotation of the rollers.

We claim:

1. A printer comprising:

a printer body:

a plurality of printing sheet outlet means arranged at different portions on said printer body;

a stacker mount provided in each of said respective outlet means;

a detachable stacker constituted as a single unit adapted to be selectively mounted at any one of said stacker mounts, said stacker comprising a cut sheet supporting portion and an ejection means for ejecting cut sheets onto said supporting portion; and drive transmitting means for transmitting a driving force to said ejecting means of said stacker when said stacker is selectively mounted on a stacker in one of said outlet means.

2. A printer as set forth in claim 1, wherein said drive transmitting means comprise a plurality of drive transmitting means and one of said drive transmitting means is associated with each stacker mount so that, when said stacker is selectively mounted at one of said plurality of stacker mounts, said ejecting means of the stacker is operatively connected to said drive transmitting means associated with said one stacker mount.

3. A printer as set forth in claim 2, wherein said plurality of drive transmitting means are connected to a single drive source.

4. A printer as set forth in claim 2, wherein said ejecting means of the stacker comprises at least one eject roller, so that, when said stacker is selectively mounted on one of said plurality of stacker mounts, said eject roller of the stacker is operatively connected to one of said drive transmitting means associated with said one stacker mount.

5. A printer as set forth in claim 1, wherein a printing sheet outlet means is arranged on each of front and rear portions of said printer body, a stacker mount is provided in each of said front and rear outlet means and said drive transmitting means transmits a driving force to the ejecting means of said stacker when said stacker is selectively mounted on one of said stacker mounts.

6. A printer comprising:

a printer body:

a plurality of printing sheet outlet means arranged at different portions on said printer body;

a plurality of stacker mounts provided in said respective outlet means;

a stacker constituted as a single detachable unit comprising a cut sheet supporting portion and an ejection means for ejecting cut sheets onto said supporting station, said ejection means comprising at least one eject roller; and a plurality of drive transmitting means for transmitting a driving force to said eject roller of said stacker when said stacker is selectively mounted at one of said plurality of stacker mounts, and wherein one of said drive transmitting means is associated with each stacker mount so that, when said stacker is selectively mounted at one of said stacker mounts, said eject roller of the stacker is operatively connected to said drive transmitting means associated with said on stacker mount, each of said drive transmitting means comprising a first gear and said stacker including a second gear operatively connected to said eject roller, so that said second gear is engaged with said first gear when said stacker is selectively mounted on any one of said stacker mounts.

* * * * *

UNITED STATES PATENT AND TRADEMARK OFFICE

CERTIFICATE OF CORRECTION

PATENT NO. : 5,083,880

DATED : January 28, 1992

INVENTOR(S) : Mitsugu Inomata, Haruhisa Inagaki and Fumio Nakao

It is certified that error appears in the above-identified patent and that said Letters Patent is hereby corrected as shown below:

Column 1, line 42, after "body" insert --;--;

line 44, after "body" insert --;--;

line 64, after "portion" insert --;--.

Colunm 7, line 6, "on" should be --one--.

Signed and Sealed this

Eighth Day of June, 1993

*Attest:*

Michael K. Kirk

MICHAEL K. KIRK

*Attesting Officer*

*Acting Commissioner of Patents and Trademarks*